US005848886A

United States Patent [19]

Michaud

[11] Patent Number: 5,848,886

[45] Date of Patent: Dec. 15, 1998

[54] CANDLE HOLDER

[76] Inventor: Bruce P. Michaud, 37 Lee St., Marblehead, Mass. 01945

[21] Appl. No.: 825,872

[22] Filed: Apr. 2, 1997

[51] Int. Cl.[6] ..... F23D 3/16

[52] U.S. Cl. ..... 431/292; 431/389; D26/9

[58] Field of Search ..... 431/288, 289, 431/292, 295; D26/6, 9, 10

[56] References Cited

U.S. PATENT DOCUMENTS

| | | | |
|---|---|---|---|
| 276,602 | 5/1883 | Kirk . | |
| 987,969 | 3/1911 | Doody | 431/295 |
| 4,555,231 | 11/1985 | Kustka | 431/288 |

FOREIGN PATENT DOCUMENTS

| | | | |
|---|---|---|---|
| 11788 | of 1898 | United Kingdom | 431/289 |

OTHER PUBLICATIONS

English Language Abstract for DE 3431–018–A, Mar. 6, 1986, Schirneker, Derwent Publication Ltd., 1986.

*Primary Examiner*—Carroll B. Dority
*Attorney, Agent, or Firm*—Wolf, Greenfield & Sacks, P.C.

[57] ABSTRACT

A candle holder to support a candle on its side so that both ends of the candle, which include an exposed wick, can be simultaneously burned. The candle holder includes a base having an upper surface that is adapted to support the candle. The candle holder may also include a pair of drip plates extending from opposite ends of the base to underlie the ends of the candle and catch wax drippings from the candle. The drip plates may include wells that hold the wax drippings. When embodied as a novelty item, the candle holder may support an actual or a simulated candle that may be configured to have the appearance that it can be or has been burned. Actual or simulated wax drippings may be disposed on the drip plates to enhance the appearance that the candle has been burned.

20 Claims, 1 Drawing Sheet

CANDLE HOLDER

BACKGROUND OF THE INVENTION

1. Field of the Invention

The present invention relates to a candle holder.

2. Description of Related Art

A conventional candle includes a molded or dipped body of wax or the like containing a wick that is burned from one end to give off light, heat or a scent. Typically, the candle is vertically supported in a candle holder or candlestick having a socket that receives the bottom of the candle so that the top end of the candle can be burned.

SUMMARY

The present invention is a candle holder that supports a candle on its side so that both ends of the candle may be burned simultaneously to provide additional light, heat or scent. When embodied as a novelty item, an actual or simulated candle may be supported on the candle holder, and the candle may be configured to have the appearance that it can be or has been burned at both ends. The candle may be attached to the candle holder reducing the possibility that the candle could become accidentally dislodged from the holder.

In one embodiment, the candle holder includes a base that supports the candle on its side. The candle may be horizontally supported on an upper surface of the candle holder, and the upper surface may be contoured to securely retain the candle.

In another embodiment, the candle holder includes a pair of drip plates extending from the base to underlie the ends of the candle to catch wax drippings from the candle. The drip plates may have wells that hold the wax drippings. When embodied as a novelty item, actual or simulated wax drippings may be disposed on the drip plates to enhance the appearance that the candle has been burned.

BRIEF DESCRIPTION OF THE DRAWINGS

It should be understood that the drawings are provided for the purpose of illustration only and are not intended to define the limits of the invention. The foregoing and other objects and advantages of the present invention will become apparent with reference to the following detailed description when taken in conjunction with the accompanying drawings in which.

DETAILED DESCRIPTION OF THE PREFERRED EMBODIMENT

Figure 1:
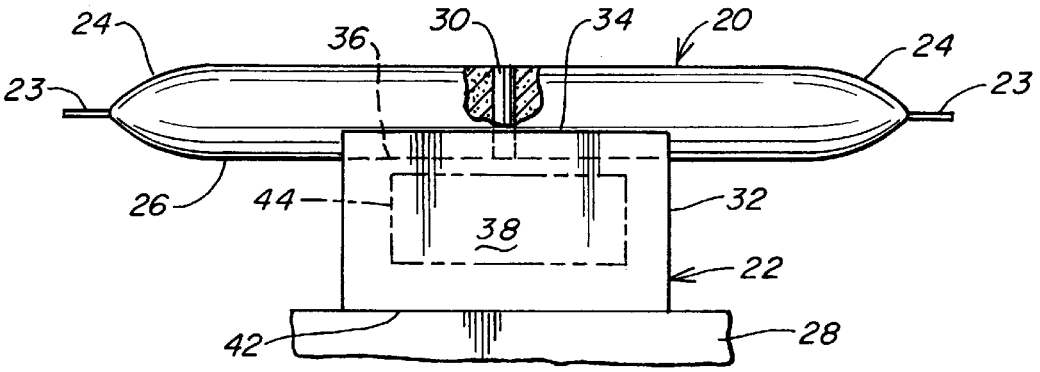
FIG. 1 is a front view of an illustrative embodiment of a candle holder according to the present invention supporting a candle having an exposed wick at its opposite ends.
Figure 2:
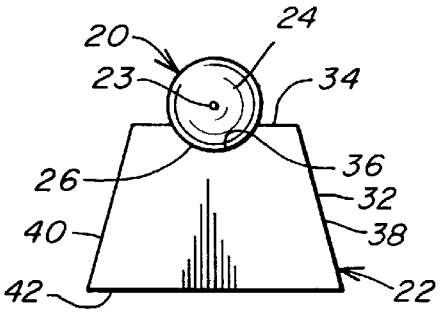
FIG. 2 is an end view of the candle holder of FIG. 1.
Figure 3:
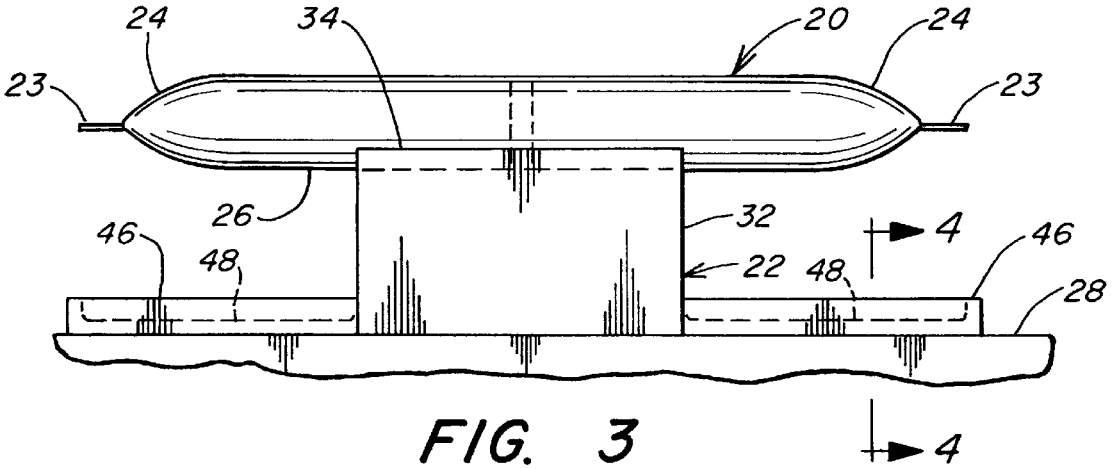
FIG. 3 is a front view of another illustrative embodiment of a candle holder according to the present invention supporting a candle having an exposed wick at its opposite ends.

A two-ended candle 20, which is a candle having an exposed wick at opposite ends, may be supported on a candle holder 22 as illustrated in FIG. 1–3. This arrangement advantageously allows one to simultaneously burn the exposed wick 23 from opposite ends 24 of the candle 20 for additional light, heat, fragrance or the like. When embodied as a novelty item, the candle 20 may be an actual or a simulated candle, and it may be configured to have the appearance that it can be or has been burned at both ends.

The candle 20 may be positioned on its side 26 and supported above a table, shelf or similar supporting surface 28 by the candle holder 22. To ensure a sufficient amount of air for sustaining a flame, the ends 24 of the candle may extend beyond the candle holder so that air flows more freely around the candle. As illustrated, the candle 20 may be horizontally supported in a complementary recess in the candle holder 22. The candle 20 may be further fixed in the recess using a fastener 30, such as a pin, nail or other fastener apparent to one of skill in the art, so that the candle 20 cannot become accidentally dislodged from the candle holder 22 when the candle is burning.

In one embodiment as illustrated in FIGS. 1 and 2, the candle holder includes a base 32 with an upper surface 34 for supporting the candle 20 above the supporting surface 28. The base 32 may preferably include a recess 36, as shown in FIG. 2, extending along the length of the upper surface 34 to more securely support the candle. The recess 36 may be configured so that it conforms to the profile of the candle. As illustrated, the recess 36 has a semicircular shape corresponding to the profile of typical candle shapes.

To provide a more stable candle holder, the front and rear walls 38, 40 of the base 32 may be tapered or angled toward each other, as shown in FIG. 2, so that the bottom surface 42 of the base is wider than the upper surface 32. This reduces the possibility that the candle holder could be accidentally tipped over.

The front wall 38 may be inscribed with or support a plaque carrying indicia directed to a descriptive legend 44 or the like. For example, the descriptive legend may be related to the old adage of "burning the candle at both ends", such as "for those who burn it at both ends". In conjunction with such a legend, the exposed wick 23 at each end of the candle 20 may be pre-burned or otherwise blackened to give an observer the impression that the candle has been burned. Such a configuration may be particularly suitable as a novelty item.

Figure 4:
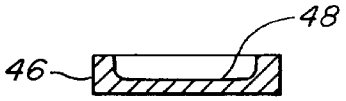
FIG. 4 is a cross-sectional view taken along section line 4—4 of FIG. 3 illustrating a well for catching candle drippings.

In another embodiment as illustrated in FIGS. 3 and 4, the candle holder 22 may include a pair of drip plates 46 extending from opposite ends of the base 32 and underlying the candle ends 24 to protect the supporting surface 28 from hot wax drippings. The drip plates 46 should have a length that is sufficient to underlie the entire end 24 of a previously unburned candle extending beyond the base. To ensure sufficient air flow around the candle for sustaining a flame, the drip plates 46 may be spaced below the upper surface 28 and recess 36, preferably extending from the bottom portion of the base. The drip plates 46 may be integrally formed with the base to create a unitary structure for the candle holder or they may be attached to the base in a manner apparent to one of skill in the art.

Each drip plate 46 preferably may include a well 48, as shown in FIG. 4, extending along a substantial portion of its length to catch wax drippings. The wells 48 may have closed ends so that the melted wax cannot run out of the well and onto the supporting surface 28. Additionally, the wells 48 may have a capacity that is sufficient to hold a quantity of melted wax from more than one candle. When embodied as a novelty item, actual or simulated wax drippings may be disposed on the drip plates to create the appearance that the candle has been burned.

The candle holder preferably is made from a rigid and heat resistant material. However, any material apparent to one skilled in the art may be used, particularly when the candle holder is used as a novelty item. The candle may be made using conventional methods known in the art and include tapered candle ends 24, as shown in FIGS. 1 and 3, or non-tapered ends. The candle may be colored or scented, and as a novelty item, the candle may be an actual candle that may be burned or a simulated candle that is not intended to be burned.

The candle holder of the present invention supports a candle having an exposed wick at opposite ends to provide a user with the option to simultaneously burn both ends of the candle to increase the amount of light, heat or scent from the candle. Additionally, the candle holder may be used as a novelty item with a two-ended candle, particularly in conjunction with a descriptive legend related to the old adage "burning the candle at both ends". Other candle holder configurations also would be suitable for use in the present invention as would be apparent to one of skill in the art.

From the foregoing description, it will be appreciated that the candle holder of the present invention provides a convenient support for a two-ended candle. It is to be appreciated, however, that the candle holder may be used in conjunction with any multi-ended candle for simultaneously burning the ends of the candle.

Having described a particular embodiment of the invention in detail, various modifications and improvements will readily occur to those skilled in the art. Such modifications and improvements are intended to be part of this disclosure and within the spirit and scope of the invention. Accordingly, the foregoing description is by way of example only and the invention is defined by the following claims and their equivalents.

What is claimed is:

1. An apparatus comprising:

a candle having a wick exposed from at least two ends; and a candle holder supporting the candle thereon, the candle holder having a recess therein, the candle lying on its side in the recess and being affixed to the candle holder with the at least two ends of the candle extending beyond the candle holder.

2. The apparatus recited in claim 1, wherein the recess is provided in an upper surface of the candle holder.

3. The apparatus recited in claim 2, wherein the recess is contoured to conform to the candle.

4. The apparatus recited in claim 3, wherein the recess has a semicircular shape.

5. An apparatus comprising:

a candle having a wick exposed from at least two ends;

a candle holder supporting the candle thereon, the candle lying on its side; and a pair of drip plates underlying the at least two ends of the candle to catch candle drippings.

6. The apparatus recited in claim 5, wherein each drip plate has a well that is adapted to hold the candle drippings.

7. The apparatus recited in claim 6, wherein the well extends along a substantial portion of the length of the drip plate.

8. The apparatus recited in claim 1, wherein the candle is horizontally supported on the candle holder.

9. The apparatus recited in claim 1, wherein the exposed wick is blackened.

10. The apparatus recited in claim 9, wherein the exposed wick is burned.

11. The apparatus recited in claim 1, wherein the candle holder includes indicia thereon.

12. The apparatus recited in claim 11, wherein the candle holder includes a plaque, the indicia being disposed on the plaque.

13. The apparatus recited in claim 1, wherein the holder includes a front wall and a rear wall that are angled toward each other from a bottom surface of the holder toward the upper surface.

14. A candle holder for a candle having an exposed wick at opposite ends, the candle holder comprising:

a base including a surface that is constructed and arranged to support a side of the candle thereon; and a pair of drip plates disposed on the base to underlie the opposite ends of the candle, the drip plates being adapted to catch drippings from the candle.

15. The candle holder recited in claim 14, wherein each drip plate has a well that is adapted to hold the drippings.

16. The candle holder recited in claim 15, wherein the base has a recess in the surface that is adapted to receive the candle.

17. An apparatus comprising:

a candle having an exposed wick at opposite ends thereof, and means for supporting the candle so that both ends of the candle can burn simultaneously; and means for catching drippings from each end of the candle, the means for catching drippings being provided on the means for supporting the candle.

18. The apparatus recited in claim 1, wherein the candle is affixed with a fastener that engages at least a portion of the candle.

19. The apparatus recited in claim 18, wherein the fastener extends from the candle holder and through the portion of the candle.

20. The apparatus recited in claim 1, wherein the at least two ends are disposed at opposite ends of the candle.

* * * * *